US011001067B2

(12) United States Patent
Lee et al.

(10) Patent No.: US 11,001,067 B2
(45) Date of Patent: May 11, 2021

(54) CHEMICAL LIQUID SUPPLY ASSEMBLY

(71) Applicants: Semes Co., Ltd., Cheonan-si (KR); Samsung Display Co., LTD., Yongin-si (KR)

(72) Inventors: Eonseok Lee, Cheonan-si (KR); Dongjin Lee, Cheonan-si (KR); Boramchan Sung, Anyang-si (KR); Dongyun Lee, Cheonan-si (KR); Daesung Kim, Cheonan-si (KR)

(73) Assignees: Semes Co., Ltd., Cheonan-si (KR); Samsung Display Co., LTD., Yongin-si (KR)

( * ) Notice: Subject to any disclaimer, the term of this patent is extended or adjusted under 35 U.S.C. 154(b) by 0 days.

(21) Appl. No.: 16/667,100

(22) Filed: Oct. 29, 2019

(65) Prior Publication Data

US 2020/0139715 A1 May 7, 2020

(30) Foreign Application Priority Data

Nov. 2, 2018 (KR) ..... 10-2018-0133430

(51) Int. Cl.
*B41J 2/175* (2006.01)

(52) U.S. Cl.
CPC ..... *B41J 2/175* (2013.01)

(58) Field of Classification Search
CPC ..... B41J 2/175; B41J 2/19; B41J 2/39; B41J 2/17596
See application file for complete search history.

(56) References Cited

U.S. PATENT DOCUMENTS

2007/0285455 A1* 12/2007 Kusunoki ..... B41J 2/19 347/19
2009/0303283 A1* 12/2009 Nakano ..... B41J 2/175 347/33
2010/0079562 A1* 4/2010 Katada ..... B41J 2/175 347/85
2014/0118448 A1* 5/2014 Domae ..... B41J 2/18 347/89

FOREIGN PATENT DOCUMENTS

| | | | |
|---|---|---|---|
| JP | 2011-148224 | A | 8/2011 |
| KR | 10-2009-0005586 | A | 1/2009 |
| KR | 10-1096307 | B1 | 12/2011 |
| KR | 10-1397446 | B1 | 5/2014 |
| KR | 10-2017-0085969 | A | 7/2017 |
| KR | 10-1776017 | B1 | 9/2017 |
| WO | WO 2016-042993 | A1 | 3/2016 |

* cited by examiner

*Primary Examiner* — Anh T Vo
(74) *Attorney, Agent, or Firm* — Daly, Crowley Mofford & Durkee, LLP

(57) ABSTRACT

A chemical liquid supply assembly may include a chemical liquid supply line for providing chemical liquid to ink jet heads. The chemical liquid supply assembly may include a main line having a first diameter and extending in a first direction, branched lines divided from the main line in a second direction perpendicular to the first direction and connected to the ink jet heads, each of the branched line having a second diameter smaller than the first diameter, and a discharge line connected to one end portion of the main line such that bubbles generated in the chemical liquid supply line are discharged out of the chemical liquid supply line while the chemical liquid supply assembly provides the chemical liquid to the ink jet heads.

4 Claims, 2 Drawing Sheets

CHEMICAL LIQUID SUPPLY ASSEMBLY

CROSS-REFERENCE TO RELATED APPLICATION

This application claims priority to Korean Patent Application No. 10-2018-0133430 filed on Nov. 2, 2018 in the Korean Intellectual Property Office (KIPO), the contents of which are herein incorporated by reference in its entirety.

BACKGROUND

1. Field

Example embodiments of the invention relate to a chemical liquid supply assembly. More particularly, example embodiments of the invention relate to a chemical liquid supply assembly including a chemical liquid supply line for providing chemical liquid to ink jet heads.

2. Related Technology

In processes for manufacturing a display device such as a liquid crystal display device or an organic light emitting display device, a printing process for coating chemical liquid onto a substrate is performed to form an orientation film or a color filter on the substrate. The printing process can usually be carried out using ink jet heads which can discharge the chemical liquid onto the substrate.

In the conventional printing process, at least two ink jet heads are provided as one pack, and the chemical liquid should be uniformly supplied to the at least two ink jet heads. In this case, the chemical liquid may not be uniformly provided to the ink jet heads when a supply line is configured only in a direction identical or similar to a direction where the chemical liquid flows. Further, bubbles may be generated in the supply line as the chemical liquid is continuously supplied to the ink jet heads, however, such bubbles may not be properly discharged out of the supply line.

SUMMARY

It is an object of the invention to provide a chemical liquid supply assembly capable of uniformly providing chemical liquid to ink jet heads and easily removing bubbles generated during the supply of the chemical liquid.

According to aspects of the invention, there is provided a chemical liquid supply assembly including a chemical liquid supply line for providing chemical liquid to at least one ink jet head. The chemical liquid supply assembly may include a main line having a first diameter and extending in a first direction, branched lines divided from the main line in a second direction substantially perpendicular to the first direction and connected to the at least one ink jet head wherein each of the branched line may have a second diameter substantially smaller than the first diameter, and a discharge line connected to one end portion of the main line such that bubbles generated in the chemical liquid supply line are discharged out of the chemical liquid supply line while the chemical liquid supply assembly provides the chemical liquid to the at least one ink jet head.

In example embodiments, the chemical liquid supply assembly may provide the chemical liquid to three ink jet heads and the branched lines may be connected to the three ink jet heads, respectively.

In example embodiments, a buffer space may be provided in the main line while the chemical liquid supply assembly provides the chemical liquid to the at least one ink jet head, such that the chemical liquid may not fully fill the main line.

In some example embodiments, the chemical liquid supply assembly may additionally include a valve installed in the discharge line to open and close the discharge line.

In some example embodiments, the main line may be connected to a chemical liquid reservoir for storing the chemical liquid provided to the at least one ink jet head, and wherein the chemical liquid supply assembly may additionally include a connection member disposed in the main line and connected to the chemical liquid reservoir, wherein the connection member may have a third diameter substantially smaller than the first diameter.

In some example embodiments, the connection member may be disposed adjacent to the other end portion of the main line.

In the chemical liquid supply assembly according to example embodiments of the invention, the branched lines may be substantially perpendicularly divided from the main line and each of the branched lines may have a diameter substantially smaller than that of the main line. Therefore, the chemical liquid may be uniformly supplied to the ink jet heads using the chemical liquid supply assembly. Further, the bubbles generated in the chemical liquid supply line may be easily discharged through the discharge line out of the chemical liquid supply line while the chemical liquid supply assembly provides the chemical liquid to the ink jet heads. As a result, the reliability of processes for manufacturing integrated circuit devices such as display devices or semiconductor devices may be improved using the chemical liquid supply assembly.

BRIEF DESCRIPTION OF THE DRAWINGS

Example embodiments will be more clearly understood from the following detailed description taken in conjunction with the accompanying drawing. The following figures represent non-limiting, example embodiments as described herein.

DESCRIPTION OF EMBODIMENTS

Figure 1:
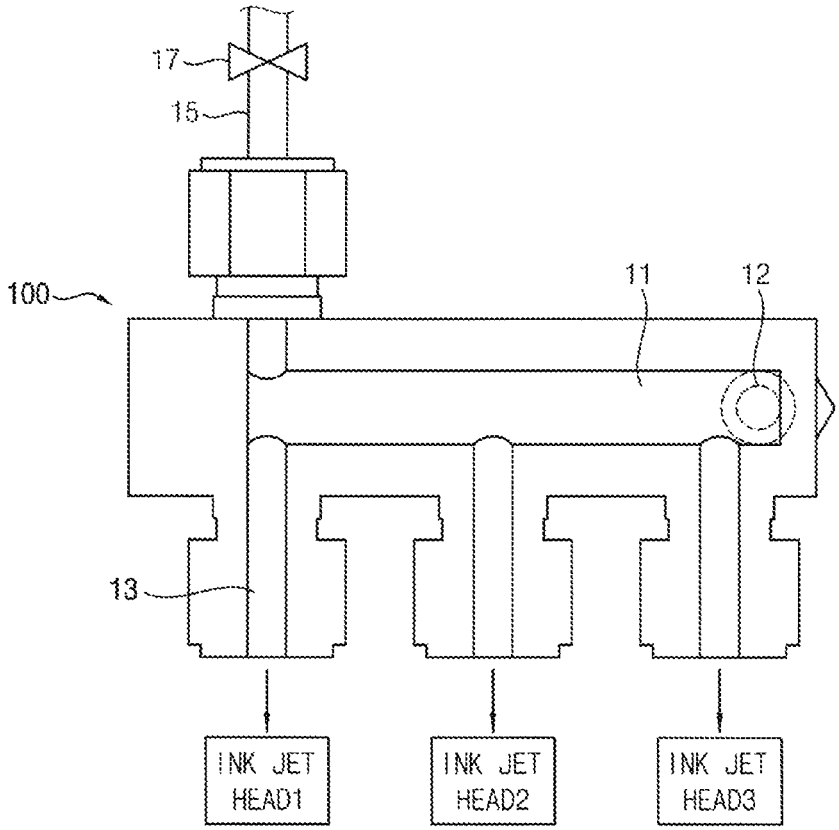
FIG. 1 illustrates a schematic configuration of a chemical liquid supply assembly in accordance with example embodiments of the invention.

Various embodiments will be described more fully hereinafter with reference to the accompanying drawings, in which some embodiments are shown. The invention may, however, be embodied in many different forms and should not be construed as limited to the embodiments set forth herein. Rather, these embodiments are provided so that this description will be thorough and complete, and will fully convey the scope of the invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (for example, rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include a plurality of forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-sectional illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the face through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, it will be described a chemical liquid supply assembly according to example embodiments with reference to the accompanying drawings.

FIG. 1 illustrates a schematic configuration of a chemical liquid supply assembly in accordance with example embodiments of the invention.

Referring to FIG. 1, a chemical liquid supply assembly 100 according to example embodiments may be used in manufacturing processes for integrated circuit devices such as semiconductor device, display device, etc. For example, the chemical liquid supply assembly 100 may be employed in manufacturing processes for integrated circuit devices performed using various fluids such as an etchant, an etching gas, photoresist, cleaning solution, coating solution, etc. In example embodiments, the chemical liquid supply assembly 100 may be used particularly in a process for coating chemical liquid on a substrate to form an orientation film or a color filter in processes for manufacturing a display device such as a liquid crystal display device, an organic light emitting display device, etc.

When the chemical liquid supply assembly 100 is used in the processes for manufacturing the display device, the chemical liquid supply assembly 100 may have a structure connected to more than one ink jet head which can provide the substrate with the chemical liquid so as to form the orientation film or the color filter on the substrate. In example embodiments, the chemical liquid supply assembly 100 may include a chemical liquid supply line which can be in fluid communication with the more than one ink jet head such that the chemical liquid supply assembly 100 may provide the chemical liquid to the more than one ink jet head.

The chemical liquid supply line of the chemical liquid supply assembly 100 may be provided in a body including a material which can have good corrosion resistance, for example, stainless steel. In this case, the body may be formed using a material which can have low reactivity relative to the chemical liquid and good machinability, for example, steel, resins, plastics, etc.

As illustrated in FIG. 1, the chemical liquid supply line of the chemical liquid supply assembly 100 may include a main line 11, branched lines 13 and a discharge line 15.

The main line 11 of the chemical liquid supply line may be fluid communication with a chemical liquid reservoir (not illustrated) which can store the chemical liquid to be supplied to a plurality of ink jet heads (i.e., but not limited to, an ink jet head 1, an ink jet head 2 and an ink jet head 3). Here, at least two ink jet heads may be provided by one pack. In example embodiments, a connection member 12 may be provided in the main line 11 and the connection member 12 may be connected to a line for delivering the chemical liquid from the chemical liquid reservoir. For example, the connection member 12 may be disposed adjacent to one end portion of the main line 11.

The main line 11 may extend along a first direction in the body. Here, the first direction where the main line 11 extends may be substantially parallel to the plurality of ink jet heads (the ink jet head 1, the ink jet head 2 and the ink jet head 3). For example, the first direction may be substantially parallel to a nozzle surface where a plurality of nozzles of the ink jet head may be arranged.

In example embodiments, the main line 11 may have a first diameter. Here, the first diameter of the main line 11 may have a dimension wherein the main line 11 is not fully filled with the chemical liquid while the chemical liquid is supplied to the plurality of ink jet heads. For example, when the chemical liquid supply assembly 100 provides the chemical liquid to the plurality of ink jet heads, a buffer space may be provided in the main line 11 by the first diameter so that the chemical liquid is not filled up to an inner upper surface of the main line 11.

The branched lines 13 may be divided from the main line 11 and may be separated by a predetermined distance. The branched lines 13 may be connected to the plurality of ink jet heads (the ink jet head 1, the ink jet head 2 and the ink jet head 3) respectively. Here, the number of the branched lines 13 may be substantially identical to the number of the ink jet heads.

In example embodiments, the branched lines 13 may extend from the main line 11 along a second direction. Here, the second direction where the branched lines 13 extend may be substantially perpendicular to the first direction where the main line 11 extends. For example, the second direction may be substantially perpendicular to the nozzle surface where the plurality of nozzles of the ink jet head may be arranged.

In example embodiments, each of the branched lines 13 may have a second diameter. In this case, the second diameter may be substantially smaller than the first diameter of the main line 11.

Referring now to FIG. 1, if the connection member 12 has a diameter larger than the first diameter of the main line 11, the buffer space may be provided in the main line 11 while the chemical liquid supply assembly 100 provides the ink jet heads with the chemical liquid. Therefore, the connection member 12 may have a third diameter substantially smaller than the first diameter of the main line 11 for forming the buffer space in the main line 11. For example, the third diameter of the connection member 12 may be substantially identical to, or similar to the second diameter of each branched line 13.

As described above, the chemical liquid supply assembly 100 may include the main line 11 having the first diameter, the branched lines 13 having the second diameter substantially smaller than the first diameter, and the connection member 12 having the third diameter substantially smaller than the first diameter. Further, the buffer space may be provided in the main line 11 considering the flow of the chemical liquid. The flow rate of the chemical liquid supplied to each of the ink jet heads may be substantially constantly maintained by the buffer space in the main line 11 and the branched lines 13 divided from the main line 11, and thus the chemical liquid supply assembly 100 may provide each of the ink jet heads with a substantially uniform amount of the chemical liquid. As a result, each of the ink jet heads may discharge a constant amount of chemical liquid from the chemical liquid supply assembly 100 onto a substrate in a predetermined process performed on the substrate such that a uniform film or layer may be formed on the substrate.

As illustrated in FIG. 1, bubbles may be generated in the chemical liquid supply line while providing the chemical liquid from the chemical liquid supply assembly 100 to the ink jet heads (the ink jet head 1, the ink jet head 2 and the ink jet head 3). The discharge line 15 may discharge the bubbles generated in the chemical liquid supply line out of the chemical liquid supply line. In example embodiments, the discharge line 15 may be in fluid communication with the main line 11. For example, the discharge line 15 may be connected to the other end portion of the main line 11. According to some example embodiments, the discharge line 11 may be coupled to the main line 11 in a combination manner such as a screw joint, a bolt joint, etc. In some example embodiments, a valve 17 may be installed in the discharge line 15. The valve 17 may open or close the discharge line 15.

In the chemical liquid supply assembly 100 according to some example embodiments, the bubbles generated in the chemical liquid supply line may be gathered in the buffer space of the main line 11 because of the density difference between the chemical liquid and the bubbles while providing the chemical liquid from the chemical liquid supply assembly 100 to the ink jet heads. In this case, the valve 17 may be opened such that the bubbles may be discharged through the discharge line 15 out of the chemical liquid supply line from the buffer space of the main line 11. Therefore, the chemical liquid supply assembly 100 may provide the ink jet heads with more uniform chemical liquid.

Figure 2:
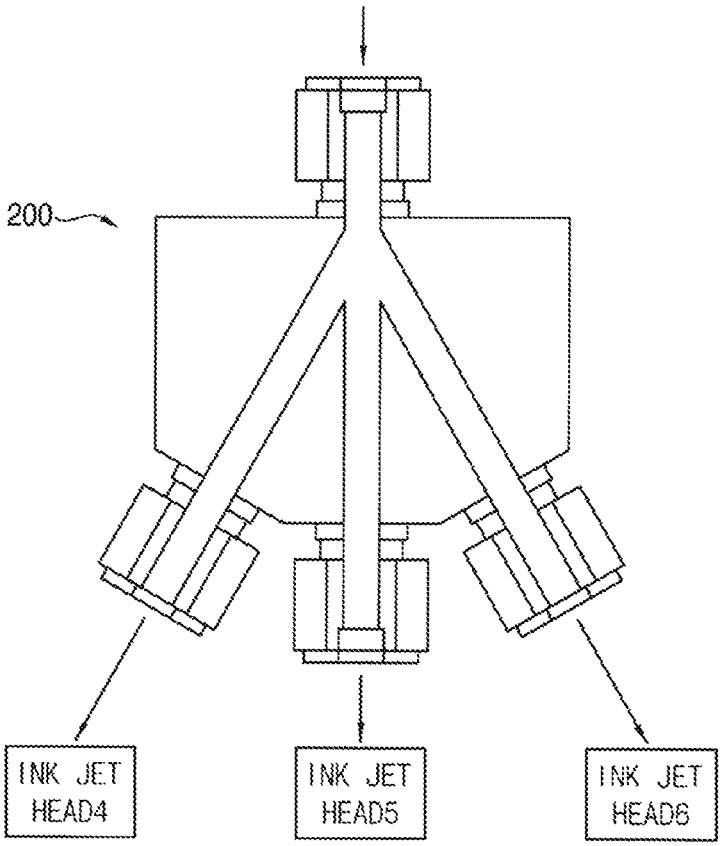
FIG. 2 illustrates amounts of chemical liquid provided to ink jet heads from a conventional chemical liquid supply assembly.

The amounts of chemical liquid provided from the chemical liquid supply assembly of the invention to the ink jet heads are compared with the amounts of chemical liquid provided from the conventional chemical liquid supply assembly to the ink jet heads. FIG. 2 illustrates amounts of chemical liquid provided to ink jet heads from the conventional chemical liquid supply assembly.

The chemical liquid was provided to the three ink jet heads (that is, the ink jet head 1, the ink jet head 2 and the ink jet head 3) using the chemical liquid supply assembly 100 illustrated in FIG. 1. Here, the chemical liquid was provided at a total flow rate of about 164 g/second to the ink jet heads 1 to the ink jet head 3 from the chemical liquid supply assembly 100. Specifically, the chemical liquid was provided to the ink jet head 1 at a flow rate of about 52 g/second, the chemical liquid was provided to the ink jet head 2 at a flow rate of about 53 g/second, and the chemical liquid was provided to the ink jet head 3 at a flow rate of about 59 g/second.

Meanwhile, the chemical liquid was provided to the three ink jet heads (that is, an ink jet head 4, an ink jet head 5 and an ink jet head 6) using the conventional chemical liquid supply assembly 200 illustrated in FIG. 2. At that time, the chemical liquid was provided at a total flow rate of about 216 g/second to the ink jet heads 4 to the ink jet head 6 from the conventional chemical liquid supply assembly 200. Specifically, the chemical liquid was provided to the ink jet head 4 at a flow rate of about 24 g/second, the chemical liquid was provided to the ink jet head 5 at a flow rate of about 165 g/second, and the chemical liquid was provided to the ink jet head 6 at a flow rate of about 27 g/second.

As described above, it was identified that the chemical liquid supply assembly of the invention could provide the ink jet heads with the chemical liquid at significantly uniform flow rate in comparison with the conventional chemical liquid supply assembly. Accordingly, the chemical liquid supply assembly of the invention may be advantageously used in processes for manufacturing an integrated circuit device such as a display device, a semiconductor device, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A chemical liquid supply assembly including a chemical liquid supply line for providing chemical liquid to a plurality of ink jet heads, which comprises:

a main line having a first diameter and extending in a first direction;

branched lines divided from the main line in a second direction perpendicular to the first direction and connected to the plurality of ink jet heads, each of the branched line having a second diameter smaller than the first diameter, each of the branched lines being arranged to provide unrestrictable flow of the chemical liquid from the main line to a different one of the plurality of ink jet heads; and a discharge line connected to one end portion of the main line such that bubbles generated in the chemical liquid supply line are discharged out of the chemical liquid supply line while the chemical liquid supply assembly provides the chemical liquid to the plurality of ink jet heads; and a valve installed in the discharge line to open and close the discharge line, wherein a buffer space is provided in the main line while the chemical liquid supply assembly provides the chemical liquid to the plurality of ink jet heads, such that the chemical liquid does not fully fill the main line, and wherein the buffer space of the discharge line is arranged to provide a substantially constant flow rate of the chemical liquid across each of the branched lines.

2. The chemical liquid supply assembly of claim 1, wherein the chemical liquid supply assembly provides the chemical liquid to three ink jet heads and the branched lines are connected to the three ink jet heads, respectively.

3. The chemical liquid supply assembly of claim 1, wherein the main line is connected to a chemical liquid reservoir for storing the chemical liquid, and wherein the chemical liquid supply assembly further comprise a connection member disposed in the main line and connected to the chemical liquid reservoir, the connection member having a third diameter smaller than the first diameter.

4. The chemical liquid supply assembly of claim 3, wherein the connection member is disposed adjacent to the other end portion of the main line.

* * * * *